United States Patent [19]

Gilmore

[11] 4,030,762

[45] June 21, 1977

[54] BOARD GAME WITH DIAGONAL PATHS

[76] Inventor: Bennett J. Gilmore, 1114 Phillips Drive, P.O. Box 1091, Dumas, Tex. 79029

[22] Filed: Apr. 8, 1976

[21] Appl. No.: 675,204

[52] U.S. Cl. ..... 273/134 AD; 273/131 AB; 273/134 D; 273/134 G

[51] Int. Cl.[2] ..... A63F 3/00

[58] Field of Search ..... 273/134, 131

[56] References Cited

UNITED STATES PATENTS

| | | | |
|---|---|---|---|
| 1,616,328 | 2/1927 | Nix | 273/134 AD |
| 1,674,791 | 6/1928 | Patocka | 273/134 AD |
| D123,817 | 12/1940 | Moring | 273/134 G UX |

FOREIGN PATENTS OR APPLICATIONS

| | | | |
|---|---|---|---|
| 848,768 | 9/1952 | Germany | 273/134 AD |
| 21,018 | 4/1913 | United Kingdom | 273/134 AD |

*Primary Examiner*—Delbert B. Lowe
*Attorney, Agent, or Firm*—Clarence A. O'Brien; Harvey B. Jacobson

[57] ABSTRACT

An octagonal game board having a planar upper surface provided with an octagonal path of movement delineated thereon and including a plurality of path segments along which game pieces are moved. Transverse or diagonal paths interconnect the opposite apices of the octagonal path, with the transverse paths also being divided into a plurality of segments. Each apex of the octagonal path of movement is provided with an externally oriented home base with opposite home bases accommodating game pieces of two partners of a team with the home bases, transverse paths of movement and the game pieces of the team players are color keyed to enable various games with various options to be played under the control of a chance control device.

1 Claim, 3 Drawing Figures

BOARD GAME WITH DIAGONAL PATHS

BACKGROUND OF THE INVENTION

1. Field of the Invention

The present invention generally relates to a game device and more particularly a board type of game device incorporating a particularly oriented path of movement thereon for receiving game pieces, with portions of the path of movement and the game pieces being color keyed and oriented in a unique arrangement to facilitate the playing of various games with various options.

2. Description of the Prior Art

Various types of game boards have been provided having segmental paths of movement delineated thereon for receiving game pieces which are moved along the paths of movement under the control of dice or other chance devices. Such previously known devices utilize various indicia and rules of play, control cards, dice, spinners, distinguishable colors, distinguishable game pieces and various rules of play by which entertaining and educational games may be played. While such game devices have been used extensively for various types of games such devices have generally been limited to rectangular or square game boards with the uniqueness residing in pictorial or artistic material on the board or indicia on the board associated with the paths of movement.

SUMMARY OF THE INVENTION

An object of the present invention is to provide a board game in which the board is of octagonal configuration, provided with a planar upper surface, an octagonal path of movement delineated thereon, transverse paths of movement interconnecting the apices on the octagonal path of movement, with the intersecting central area of the transverse paths of movement having a particular designation and certain segments of the octagonal path of movement having a particular designation and home bases designated outwardly of each of the apices of the octagonal path of movement.

Another object of the invention is to provide a game device including movable game pieces for each player with the players being separated into teams of two partners each, with the game pieces of each partner of the team being distinguishably shaped and the game pieces of the teams being distinguishably colored.

A further object of the invention is to provide a game device in accordance with the preceeding objects in which the home bases and transverse paths of movement are color-keyed to the distinguishable colors of the game pieces with the opposed home bases being similarly colored and the transverse path having the same color being oriented in perpendicular relation to a line connecting the opposed home bases of the same color.

Still another object of the present invention is to provide a game device which is unique in its association of paths of movement for the game pieces and its associational relationship of the game components which are utilized in a manner to provide an entertaining game having various options of play.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
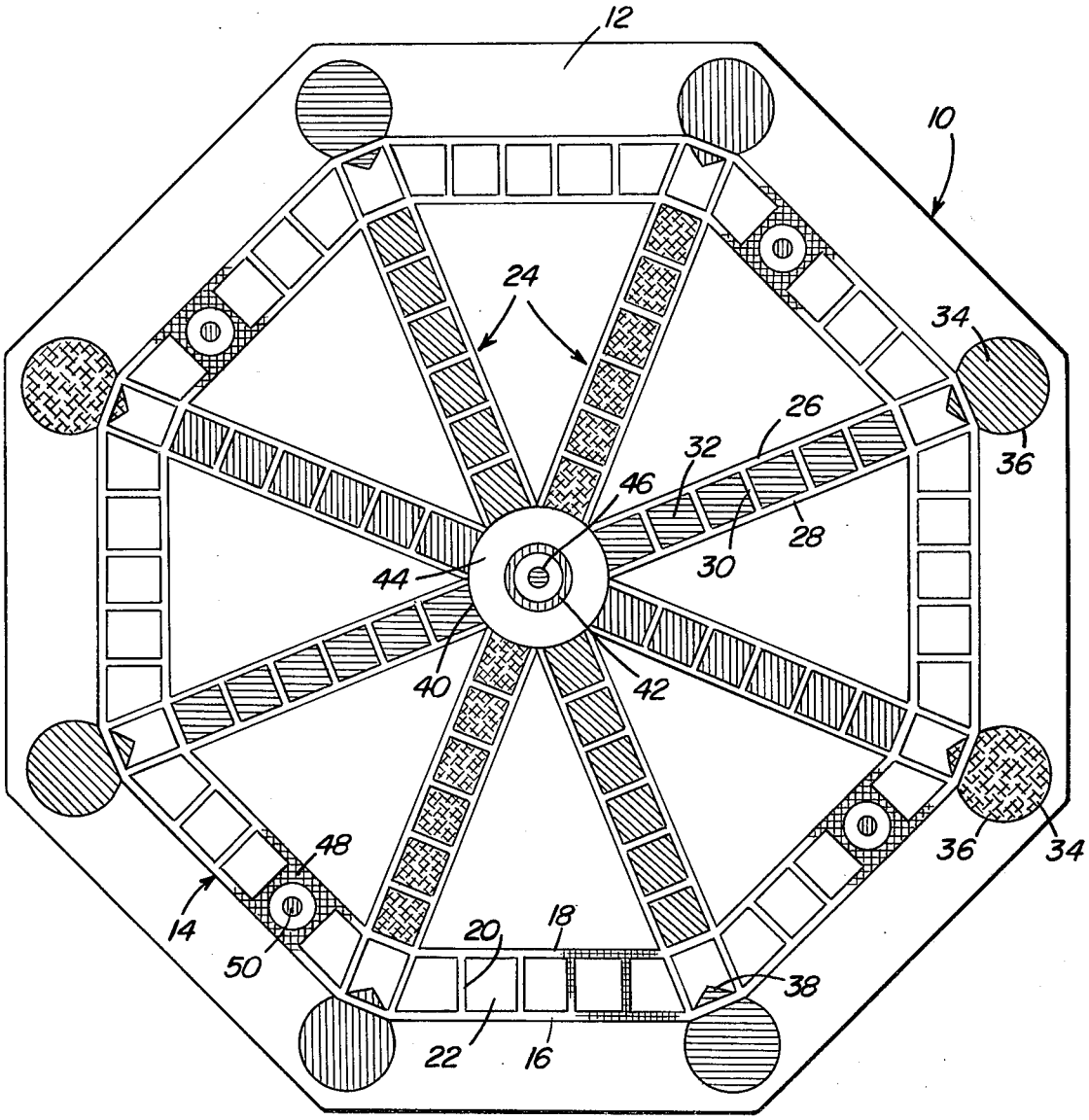
FIG. 1 is a plan view of the game board of the game device of the present invention.

The game device of the present invention includes a game board generally designated by reference numeral 10 which includes a generally rigid panel 12 of octagonal configuration in which all of the sides are equal and all of the included angles at the apices are equal. The upper surface of the panel or game board 12 is planar, with the game board being rigid throughout or, if desired, a hinge structure may be provided transversely at the center to enable it to be folded into overlapping halves. The panel or game board 12 may be constructed of heavy cardboard, paperboard, pressed-board or other material employed in the construction of game boards, with the planar upper surface thereof having certain indicia imprinted thereon or imprinted on a separate piece of paper that is glued or laminated to the game board.

The game board 12 includes an octagonal path of movement delineated thereon generally designated by the numeral 14 and defined by a pair of spaced, parallel lines 16 and 18 which are interconnected by transverse lines 20 thereby defining a plurality of segments 22 which combine to form a continuous octagonal path of movement spaced inwardly of and concentrically with the periphery of the game board 12.

Extending transversely of the path of movement 14 is a plurality of diagonal paths of movement, each generally being designated by numeral 24, in which the diagonal paths of movement connect the apices of the octagonal path of movement 14. The transverse paths of movement 24 are delineated by spaced parallel lines 26 and 28 which are interconnected by spaced transverse lines 30 thus defining a plurality of segments 32 in each transverse or diagonal path of movement 24.

Disposed outwardly of each of the apices of the octagonal path of movement 14 is a circular area 34 delineated by a circular line 36 designated as a home base. Each of the circular lines 36 are provided with a generally triangular projecting portion 38 extending into the area 22 of the octagonal path of movement 14 which defines the corresponding apex of the octagonal path of movement 14 and which defines the outermost segment of the transverse path of movement 24. The home base areas 34 and the diagonal paths of movement 24 are distinguishably colored as indicated by the hachure marks in the drawings with the diagonally opposed home base areas 34 being of the same color but with the peripherally adjacent home base areas being of different colors. As indicated, the home base areas are colored red, blue, yellow and green. The transverse paths of movement 24 are colored in the same colors but the transverse path of movement 24 is in ninety degree relationship to the home bases of the same color. When considering FIG. 1 of the drawings, the home bases oriented at generally the 7 o'clock and 1 o'clock positions are red and the transverse path extending from the 10 o'clock position to the 4 o'clock position is red. The home bases are sequentially red, green, yellow and blue in a clockwise direction and the transverse paths of movement are colored in the same pattern except that the transverse paths of movement are oriented in 90° relationship to lines connecting the home bases.

The intersecting area at the center of the game board where the transverse paths of movement 24 intersect includes concentric lines 40 and 42 which are spaced from each other with the spaces 44 and 46 defined thereby being left uncolored and being designated as a "hot spot". Also, four of the spaces 22 in the octagonal path of movement 14 are distinguishably colored as at 48 to form a dot 50 with these spaces being designated as "hot dots" which are spaced one segment or area 22 in a clockwise direction from each red and yellow home base as illustrated in FIG. 1.

Figure 2:
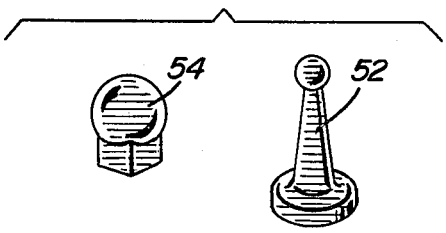
FIG. 2 is a group perspective view illustrating representative game pieces.
Figure 3:
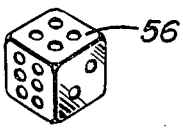
FIG. 3 is a perspective view illustrating a conventional die employed in playing the game.

FIG. 2 illustrates game pieces 52 and 54 which are of distinguishable shapes. While the shape may vary, the game piece 52 is of generally conical configuration provided with a circular base and an upwardly tapering shank provided with a rounded knob on the upper end thereof and the game piece 54 is in the form of a spherical member having a generally square or rectangular base. Each partner of four teams of players will have three game pieces assigned to him with the six game pieces of each team being of the same color and of the same color as the two home bases assigned to that team. One player of the team will receive three game pieces of the shape as indicated by numeral 52 and the other player in that team will receive three game pieces shaped as indicated at 54. The shape and configuration of the game pieces may vary as long as the shape and configuration of the game pieces of the two players or partners on a team are distinguishable and as long as all of the game pieces of the team are the same color and are the same color as the opposed home bases assigned to that team. A conventional die 56 may be used to control play of the game with the pips arranged thereon in a conventional manner.

Assuming that four teams of two players each are utilizing the game board with the game pieces assigned to the players being positioned in the respective home bases, play may be commenced by the player or team rolling a high number on the die or by any other means and in order for a player to move one piece to the entrance square which is the area 22 in which the triangular member 38 is oriented, he must role a one or a six on the die. The object of the game is for the partners to switch the position of their game pieces from their assigned home base to their partner's home base by moving along the paths of movement in accordance with the segments of movement indicated by the die 56. The "hot spot" position 46 is a blocking position and the four "hot dot" positions 50 require that the playing piece landing on one of the "hot dot" positions must move immediately to the "hot spot" position. Occupation of the "hot spot" position 46 by any player's game piece blocks all movement across the board and thus impedes the movement of all game pieces across the center of the board. The player may proceed directly across the board or he may choose to move around the board in either direction and may proceed toward his goal by moving on the various transverse or diagonal paths of movement as long as he moves in an advancing manner except when he is moving on a transverse path of movement colored the same as his game pieces in which event he can then move either right or left and exit any time to continue his advance toward his partner's home base. Thus, the team color path of movement 24 offers freedom of movement in either direction but a player may move in only one direction on each roll of the die. He may exit at either end of his transverse path of movement which is the same color as his game pieces or he may exit on any other transverse path of movement which advances him toward his partner's home base.

Players may pass their own or the other's game pieces with the exception that when any player's game piece occupies the "hot spot", all movement across that position is blocked until the player occupying it rolls a one on the die. Upon rolling a one, the player may elect to remove his piece from the "hot spot" or make another move if he has such options. If this is the only move, then he must remove his game piece from the "hot spot". Any game piece landing on a "hot dot" 50 requires a mandatory move of that game piece to the "hot spot" position. Not more than one game piece may occupy a square or area at the same time. When a player lands on any square already occupied by another player, he must bump that player and send that game piece back to its home base. A player must bump his partner home if he has no other move. When a partner's playing piece occupies the player's entrance square and the player must enter it is a forced bump and the partner's playing piece must be sent home. Only three playing pieces are allowed at home base at one time and it therefore is possible and probable that pieces will be bumped out of home base. For example, if all three of your pieces are in your partner's home base when your opponent bumps one of your partner's pieces back home, one of your pieces is bumped out and returned to its beginning home base. Also, a player's piece which occupies the "hot spot" may be bumped out of this position by his own or another player's piece. When one player on the team has all of his pieces in his partner's home base, his turn may be used to assist his partner.

The color key arrangement provides various options of movement and, by appropriate selection of movements, playing pieces may be blocked, sent back to home base and moved in various manners around and across the game board thereby rendering the game highly entertaining in view of the many options open to the players, thus developing considerable skill in determining which options are of most benefit to the team. Also, the game board 10 may have holes, recesses or the like to facilitate the use of distinguishably colored marbles as game pieces.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A game device for playing a game by a plurality of teams of players with each team including at least two players, said game device comprising a game board having a substantially planar upper surface, said game board being of octagonal configuration, an octagonal path of movement delineated on said game board in concentric, inward spaced relation to the periphery of the game board with the octagonal path of movement being divided into a plurality of segments with the apices of the octagonal path of movement being in alignment with the apices of the game board, four distinguishably colored diagonal paths of movement delineated on said game board and extending transversely between opposed apices of the octagonal path of movement, said diagonal paths being divided into a plurality of segments, a home base area delineated on the game board outwardly of each of the apices of the octagonal path of movement, said home base areas being distinguishably colored the same colors as the four diagonal paths of movement with the oppositely disposed home base areas having the same color as the diagonal path of movement oriented in ninety degree spaced relation around the periphery of the octagonal path of movement, and game pieces separated into groups having the same colors as the diagonal paths of movement and the home base areas, said groups of game pieces being assigned to the teams of players with each team's game pieces being the same color and the game pieces of each team player being distinguishable by shape from the game pieces of the other team player, said game pieces being movable from a home base area of the same color as the game pieces assigned to a team toward an opposite home base area along the octagonal path of movement or diagonal paths of movement in accordance with a chance device and selection of a mode of movement by a player.

* * * * *